US010032424B2

(12) United States Patent
Xu

(10) Patent No.: US 10,032,424 B2
(45) Date of Patent: Jul. 24, 2018

(54) GATE DRIVING CIRCUIT AND DRIVING METHOD

(71) Applicant: SHENZHEN CHINA STAR OPTOELECTRONICS TECHNOLOGY CO., LTD., Shenzhen, Guangdong (CN)

(72) Inventor: Xiangyang Xu, Shenzhen (CN)

(73) Assignee: Shenzhen China Star Optoelectronics Technology Co., Ltd., Shenzhen, Guangdong (CN)

( * ) Notice: Subject to any disclaimer, the term of this patent is extended or adjusted under 35 U.S.C. 154(b) by 954 days.

(21) Appl. No.: 14/241,804

(22) PCT Filed: Jan. 24, 2014

(86) PCT No.: PCT/CN2014/071390
§ 371 (c)(1),
(2) Date: Aug. 14, 2014

(87) PCT Pub. No.: WO2015/100828
PCT Pub. Date: Jul. 9, 2015

(65) Prior Publication Data

US 2015/0206495 A1 Jul. 23, 2015

(30) Foreign Application Priority Data

Dec. 31, 2013 (CN) ..... 2013 1 0750809

(51) Int. Cl.
*G09G 3/36* (2006.01)

(52) U.S. Cl.
CPC ... *G09G 3/3677* (2013.01); *G09G 2300/0408* (2013.01); *G09G 2310/061* (2013.01); *G09G 2320/0219* (2013.01)

(58) Field of Classification Search
CPC ..... G09G 3/3677; G09G 2300/0408; G09G 2310/061; G09G 2320/0219;
(Continued)

(56) References Cited

U.S. PATENT DOCUMENTS

2011/0122988 A1* 5/2011 Miyayama ..... G11C 19/28 377/64
2014/0354523 A1* 12/2014 So ..... G09G 3/3677 345/100

FOREIGN PATENT DOCUMENTS

CN 102915714 A 2/2013
CN 102982774 A 3/2013

OTHER PUBLICATIONS

English Translation of CN 102855938.*
English Translation and Drawings for KR 10-2013-0061481.*

* cited by examiner

*Primary Examiner* — Nelson Rosario
*Assistant Examiner* — Eboni Hughes
(74) *Attorney, Agent, or Firm* — Kim Winston LLP

(57) ABSTRACT

The present disclosure provides a gate driver circuit and a driving method. The circuit comprises multi-stage GOA circuits, an Nth stage GOA circuit of which comprises: a charge unit, electrically connected between an (N−1)th gate line and an energy storage unit, and used for pre-charging the energy storage unit according to the signal of the (N−1)th gate line to obtain a voltage; a driver unit used for pulling up the signal of the Nth gate line to a pull-up voltage according to the voltage and a clock pulse signal; a first reset unit used for resetting the signal of the Nth gate line to the first reset voltage or the third reset voltage according to the signal of an (N+1) gate line and the first reset voltage or the third reset voltage; and a second reset unit used for resetting the signal of the Nth gate line to the second reset voltage according to
(Continued)

the signal of an (N+3) gate line and the second reset voltage. In the circuit of the present disclosure, two reset units are used to achieve four-order driving for the pixel units, thus effectively solving the influence of a feed through voltage on the pixel electrode and improving the quality effect of images.

8 Claims, 4 Drawing Sheets

(58) Field of Classification Search
CPC ..... G09G 3/3266; G09G 3/3674; G09G 5/18; G09G 2310/0267; G09G 2320/045; G09G 2330/021; G11C 19/184; G11C 19/28
See application file for complete search history.

GATE DRIVING CIRCUIT AND DRIVING METHOD

FIELD OF THE INVENTION

The present disclosure relates to the field of liquid crystal display, and particularly relates to a gate driver circuit and a driving method.

BACKGROUND OF THE INVENTION

In recent years, with the trend towards thinness for display devices, liquid crystal display (LCD) has been widely used in various electronic products, such as mobile phones, notebook computers, color televisions, and the like.

Gate driver on array (GOA) is a technology in which gate driver circuits (Gate Driver ICs) are directly formed on an array substrate to replace use of external silicon wafers. With this technology, the gate driver circuits can be directly provided around a panel, thus reducing production procedures and decreasing product cost. In addition, the integration level of the TFT-LCD (thin film transistor-liquid crystal display) panel can be further improved, so that the panel becomes thinner.

When the panel is driven, a feed through voltage will be generated, and can cause the changes of display electrodes (also called pixel electrodes) due to capacitance coupling. The change of gate driver voltage has the greatest influence on the changes of display electrodes, and the gate driver voltage is influenced by a feed through voltage generated by a parasitic capacitor Cgd. Therefore, the influence of the feed through voltage can be reduced by means of compensating a common voltage. However, since liquid crystal capacitance Clc is not a fixed parameter, the objective of improving image quality by adjusting the common voltage is not easy to realize.

The traditional second-order driver GOA circuit is essentially a 4T1C circuit (comprising four TFT switches and a capacitor). FIG. 1 shows a principle diagram of the traditional second-order driver GOA circuit with 4T1C, wherein: TFT1 is a driver transistor and mainly used for controlling a gate line high-potential output; TFT2 and TFT3 are reset transistors, and mainly used for pulling down a gate line potential and releasing the charges of a holding capacitor Cb simultaneously, so as to enable TFT1 in a closed state; TFT4 is an input (or pre-charge) transistor, and mainly configured to pre-charge the holding capacitor Cb, so as to turn on TFT1. The capacitor Cb is mainly used for storing the charges, and keeping the gate potential of TFT1. The input signal of the capacitor Cb is a gate line output signal, i.e., gate[N−1], of the previous row, the output signal of TFT1 is a gate line output signal, i.e., gate[N], of the current row, and the reset signal is a gate line output signal, i.e., gate[N+1], of the next row. The input end of TFT1 is a clock signal Vck. The specific driving time sequence is shown in FIG. 2.

The above-mentioned GOA circuits can be used as GOA units to achieve a second-order driving through the following actions. That is, the output of the previous GOA unit is used as a trigger signal for the current GOA unit, and the output of the next GOA unit is used as a reset signal for the current GOA unit. Two clock signals Vclk_A and Vclk_B are used for the GOA units in odd rows and the GOA units in even rows, respectively. A gate line output potential Vss determines the heights or the amplitudes of output pulses on gate lines.

However, the above-mentioned circuits cannot overcome the defect associated with the influence brought by the feed through voltage on image effect. Therefore, how to solve the above-mentioned problems so as to provide a driving solution for effectively reducing the influence of a feed through voltage on the display effect of the image quality is one of the problems dedicated in the field.

SUMMARY OF THE INVENTION

One of the technical problems to be solved by the present disclosure is to provide a gate driver circuit, which is capable of effectively reducing the influence of a feed through voltage on the display effect of image quality. In addition, a driving method for the gate driver circuit is further provided.

1) In order to solve the above-mentioned technical problems, the present disclosure provides a gate driver circuit comprising multi-stage GOA circuits, wherein an Nth stage GOA circuit of the multi-stage GOA circuits comprises: an energy storage unit; a charge unit, electrically connected between an (N−1)th gate line and the energy storage unit, and used for pre-charging the energy storage unit according to the signal of the (N−1)th gate line to obtain a voltage; a driver unit, electrically connected to a clock output line and an Nth gate line, and used for pulling up the signal of the Nth gate line to a pull-up voltage according to the voltage and a clock pulse signal; a first reset unit, electrically connected between the energy storage unit and a first reset voltage or a third reset voltage, and used for resetting the signal of the Nth gate line to the first reset voltage or the third reset voltage according to the signal of an (N+1) gate line and the first reset voltage or the third reset voltage; and a second reset unit, electrically connected between an Nth gate line and a second reset voltage, and used for resetting the signal of the Nth gate line to the second reset voltage according to the signal of an (N+3) gate line and the second reset voltage.

2) In a preferred embodiment of item 1) of the present disclosure, when the gate line connected with the Nth stage of GOA circuit is negative, the first reset unit resets the signal of the Nth gate line to the first reset voltage according to the signal of the (N+1) gate line and the first reset voltage, wherein a negative voltage difference exists between the first reset voltage and the second reset voltage.

3) In a preferred embodiment of item 1) or 2) of the present disclosure, when the gate line connected with the Nth stage of GOA circuit is positive, the first reset unit resets the signal of the Nth gate line to the third reset voltage according to the signal of the (N+1) gate line and the third reset voltage, wherein a positive voltage difference exists between the third reset voltage and the second reset voltage.

4) In a preferred embodiment of any one of items 1) to 3) of the present disclosure, the second reset unit is a transistor provided with a gate, a first source/drain and a second source/drain, wherein the gate is electrically connected with the (N+3) gate line, and the first source/drain and the second source/drain are electrically connected with the N gate line and the second reset voltage respectively.

5) In a preferred embodiment of any one of items 1) to 4) of the present disclosure, the first reset unit comprises a first transistor and a second transistor, each being provided with a gate, a first source/drain and a second source/drain, wherein: the gates of the first transistor and the second transistor are electrically connected to each other and connected with the (N+1)th gate line; the first source/drain of the first transistor is electrically connected with the first end of the energy storage unit, and the first source/drain of the second transistor is electrically connected with the second end of the energy storage unit; and the second sources/drains of the first transistor and the second transistor are electrically connected to each other and electrically connected with the first reset voltage or the third reset voltage.

6) In a preferred embodiment of any one of items 1) to 5) of the present disclosure, the charge unit is a transistor provided with a gate, a first source/drain and a second source/drain, wherein the gate and the first source/drain of the charge unit are electrically connected with the (N−1)th gate line, and the second source/drain thereof is electrically connected with the first end of the energy storage unit.

7) In a preferred embodiment of any one of items 1) to 6) of the present disclosure, the driver unit is a transistor provided with a gate, a first source/drain and a second source/drain, wherein the first source/drain of the driver unit is electrically connected with the clock output line, the gate thereof is electrically connected with the first end of the energy storage unit, and the second source/drain thereof is electrically connected with the Nth gate line and the second end of the energy storage unit.

8) According to another aspect of the present disclosure, a driving method using any one of the above-mentioned gate driver circuits is further provided, comprising: receiving, through the charge unit, the signal of the (N−1)th gate line, and pre-charging the energy storage unit to obtain a voltage; receiving, through the driver unit, a clock pulse signal, and pulling up the signal of the Nth gate line to a pull-up voltage according to the voltage and the clock pulse signal; receiving, through the first reset unit, the signal of the (N+1) gate line and a first reset voltage or a third reset voltage, and resetting the signal of the Nth gate line to the first reset voltage or the third reset voltage according to the signal of the (N+1) gate line and the first reset voltage or the third reset voltage; and receiving, through the second reset unit, the signal of the (N+3) gate line and a second reset voltage, and resetting the signal of the Nth gate line to the second reset voltage according to the signal of the (N+3) gate line and the second reset voltage and the second reset voltage.

9) In a preferred embodiment of item 8) of the present disclosure, when the gate line connected with the Nth stage of GOA circuit is negative, the first reset unit receives the first reset voltage, and resets the signal of the Nth gate line to the first reset voltage according to the signal of the (N+1) gate line and the first reset voltage, wherein a negative voltage difference exists between the first reset voltage and the second reset voltage.

10) In a preferred embodiment of item 8) or 9) of the present disclosure, when the gate line connected with the Nth stage of GOA circuit is positive, the first reset unit receives the third reset voltage, and resets the signal of the Nth gate line to the third reset voltage according to the signal of the (N+1) gate line and the third reset voltage, wherein a positive voltage difference exists between the third reset voltage and the second reset voltage.

Compared with the prior art, one or more embodiments of the present disclosure may have the following advantages.

The present disclosure puts forward a four-order driver GOA circuit. In this circuit, two reset signals are used to pull down the gate output signal to a reset signal Vss1 and a reset signal Vss2 respectively with regard to odd rows, and to pull down the gate output signal to a reset signal Vss3 and the reset signal Vss2 respectively with regard to even rows, thus realizing four-order driving for pixel units. Moreover, the driving circuit may effectively solve the problem of the influence of the feed-through voltage on the pixel electrodes, which cannot be solved by a two-order driving circuit, thus further improving the image quality effect.

Other features and advantages of the present disclosure will be illustrated in the following description, and are partially obvious from the description or understood through implementing the present disclosure. The objectives and other advantages of the present disclosure may be realized and obtained through the structures specified in the description, claims and accompanying drawings.

BRIEF DESCRIPTION OF THE DRAWINGS

The accompanying drawings are provided for further understanding the present disclosure, constitute a part of the description, and are used for interpreting the present disclosure together with the examples of the present disclosure, rather than limiting the present disclosure. In the accompanying drawings.

DETAILED DESCRIPTION OF THE EMBODIMENTS

To make the objectives, technical solutions and advantages of the present disclosure clearer, the present disclosure is further illustrated in detail below in conjunction with the accompanying drawings.

It should be noted that, the driver circuit of the example belongs to four-order driver circuits, in which the feed through voltage can be compensated by the four-order driver circuit without changing the common voltage. In the example, the four-order driver circuit can compensate the feed through voltage generated by the parasitic capacitor Cgd by virtue of the feed through voltage generated by the storage capacitor Cs.

Figure 1:
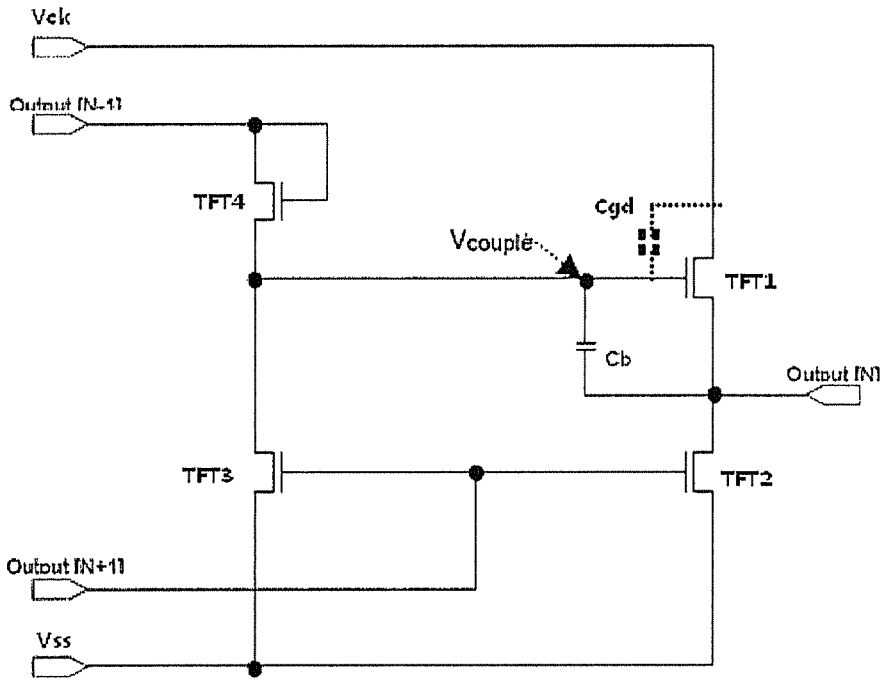
FIG. 1 is a schematic diagram of a second-order driving GOA circuit in the prior art.
Figure 2:
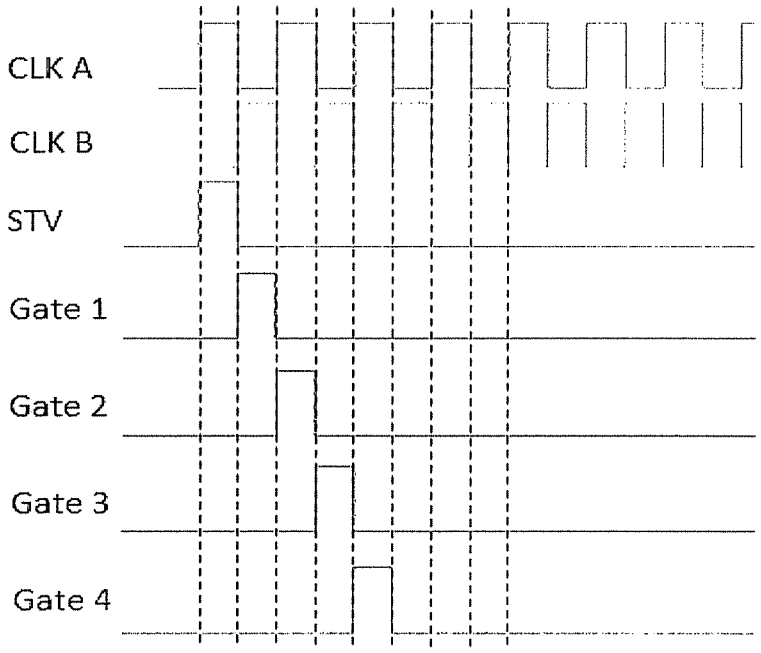
FIG. 2 is a time sequence diagram of the output of a second-order driving GOA circuit in the prior art.
Figure 3:
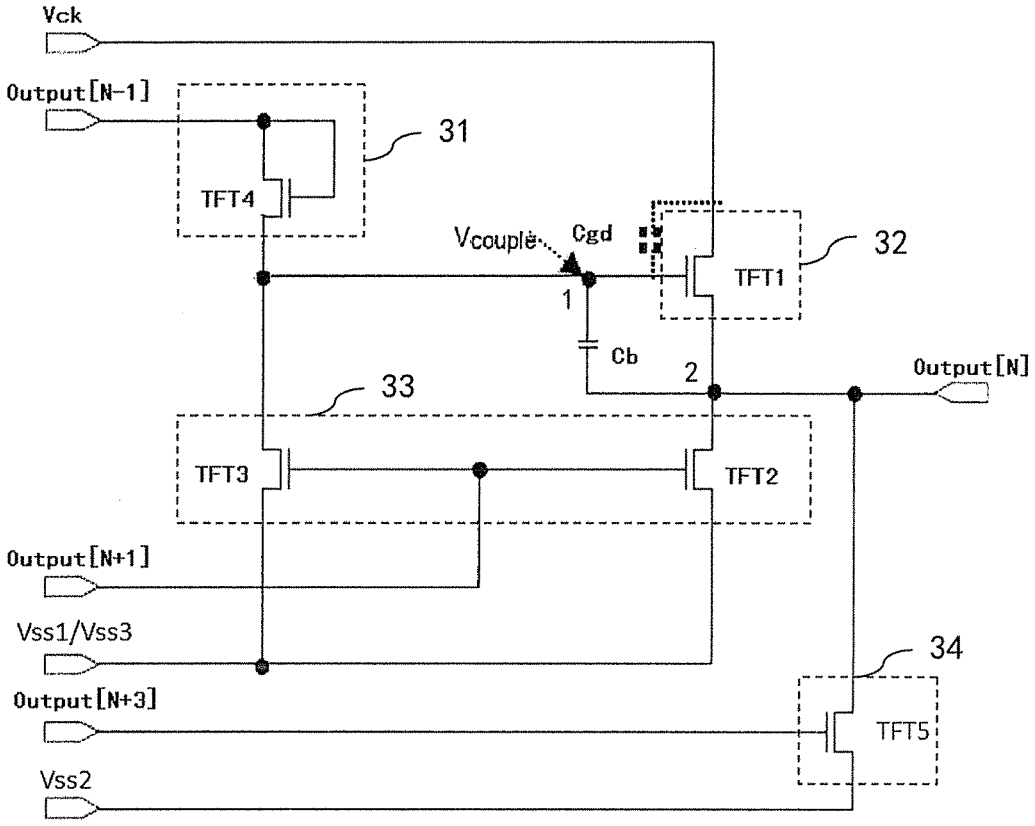
FIG. 3 is a schematic diagram of a four-order driving GOA circuit according to an example of the present disclosure.

FIG. 3 is a schematic diagram of a four-order driving GOA circuit according to an example of the present disclosure. For convenience, only an Nth stage of the GOA circuit of the multi-stage GOA circuit is shown. As shown in FIG. 3, the Nth stage of the GOA circuit comprises: an energy storage unit Cb; a charge unit 31, electrically connected between an (N−1)th gate line and the energy storage unit Cb, and used for pre-charging the energy storage unit Cb according to the signal of the (N−1)th gate line to obtain a voltage; a driver unit 32, electrically connected to a clock output line and an Nth gate line, and used for pulling up the signal of the Nth gate line to a pull-up voltage according to the voltage and a clock pulse signal; a first reset unit 33, electrically connected between the energy storage unit Cb and a first reset voltage Vss1 or a third reset voltage Vss3, and used for resetting the signal of the Nth gate line to the first reset voltage Vss1 or the third reset voltage Vss3 according to the signal of an (N+1) gate line and the first reset voltage Vss1 or the third reset voltage Vss3; and a second reset unit 34, electrically connected between an Nth gate line and a second reset voltage Vss2, and used for resetting the signal of the Nth gate line to the second reset voltage Vss2 according to the signal of an (N+3) gate line and the second reset voltage Vss2.

Figure 5:
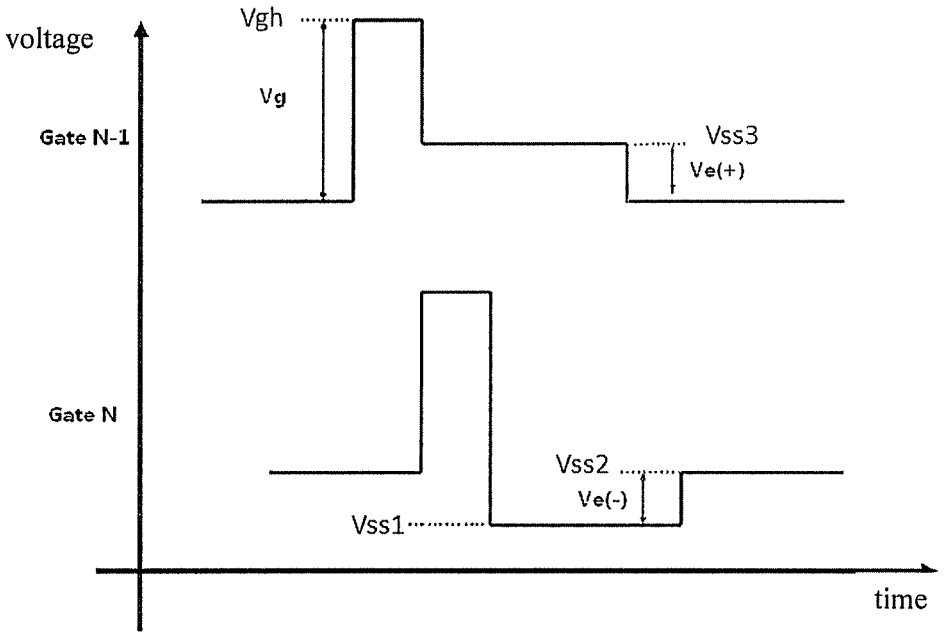
FIG. 5 is a voltage waveform schematic diagram of the four-order driving gate driver according to the present disclosure.

It should be noted that, in the case that the gate line connected with the Nth stage of GOA circuit is negative, the first reset unit 33 resets the signal of the Nth gate line to the first reset voltage Vss1 according to the signal of the (N+1) gate line and the first reset voltage Vss1, wherein a negative voltage difference, i.e., $V_{e(-)}$ as shown in FIG. 5, exists between the first reset voltage Vss1 and the second reset voltage Vss2. In comparison, in the case that the gate line connected with the Nth stage of GOA circuit is positive, the first reset unit 33 resets the signal of the Nth gate line to the third reset voltage Vss3 according to the signal of the (N+1) gate line and the third reset voltage Vss3, wherein a positive voltage difference, i.e., $V_{e(+)}$ as shown in FIG. 5, exists between the third reset voltage Vss3 and the second reset voltage Vss2.

As shown in FIG. 3, the GOA circuit is essentially a 5T4C circuit, comprising: five transistor switches consisting of a transistor TFT1 (used as a driver unit 32), transistors TFT2 and TFT3 (forming a first reset unit 33 together), a transistor TFT4 (used as a charge unit 31) and a TFT5 (used as a second reset unit 34), and a holding capacitor Cb (used as an energy storage unit). Moreover, a parasitic capacitor Cgd arranged between the gate and the drain of the TFT1 is also schematically shown in FIG. 3.

The input signals of the circuit comprise a clock signal (positive or negative) Vck, the output Output[N−1] of an (N−1)th gate line, the output Output[N+1] of an (N+1)th gate line, the output Output[N+3] of an (N+3)th gate line, a first reset signal Vss1 or a third reset signal Vss3, and a second reset signal Vss2.

The drive transistor TFT1 is provided with a gate, a first source/drain and a second source/drain. The first source/drain of the drive transistor is electrically connected with the clock output line Vck, the gate thereof is electrically connected with the first end of the capacitor Cb, and the second source/drain thereof is electrically connected with the Nth gate line and the second end of the capacitor Cb. The drive transistor TFT1 is mainly used for controlling gate line high-potential output.

TFT2, TFT3 and TFT5 are reset transistors, and are mainly used for pulling down a gate line potential, and at the same time releasing the charges of the holding capacitor Cb, so as to enable the TFT1 in a closed state.

The gates of TFT2 and TFT3 are electrically connected to each other, and connected with the (N+1)th gate line. The first source/drain of TFT2 is electrically connected with the first end of the capacitor Cb, and the first source/drain of TFT3 is electrically connected with the second end of the capacitor Cb. The second sources/drains of TFT2 and TFT3 are electrically connected to each other, and electrically connected with the first reset voltage Vss1 or the third reset voltage Vss3. As the four-order driving of the pixel voltage is realized by virtue of the different changes of positive-row and negative-row gate potentials, TFT2 resets the gate line input to a Vss1 potential for negative-row output, and resets the gate line input to a Vss3 potential for positive-row output.

TFT5 resets the gate line output to a Vss2 potential, and is driven by an output signal gate[N+3]. TFT5 is provided with a gate, a first source/drain and a second source/drain. The gate of TFT5 is electrically connected with the (N+3)th gate line, and the first source/drain and the second source/drain thereof are electrically connected with the Nth gate line and the second reset voltage Vss2 respectively.

TFT4 is an input (or pre-charging) transistor, and is mainly configured to pre-charge the holding capacitor Cb, so as to turn on TFT1. TFT4 is provided with a gate, a first source/drain and a second source/drain. The gate and the first source/drain of TFT4 are electrically connected with the (N−1)th gate line, and the second source/drain thereof is electrically connected with the first end of the capacitor Cb respectively.

Figure 4:
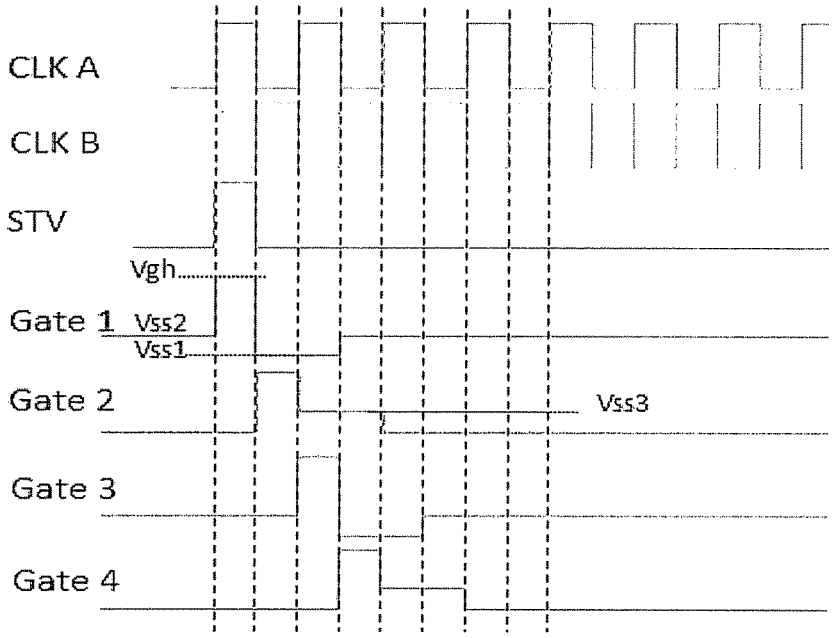
FIG. 4 is a time sequence diagram of the output of a four-order driving GOA circuit according to the present disclosure.

The specific driving time sequence is shown in FIG. 4. Two clock sequences Clk A, Clk B with an equal period but opposite polarities are adopted. The two clock sequences are used on corresponding GOA circuits on odd-row gate lines and corresponding GOA circuits on even-row gate lines respectively.

In the following, how to realize the four-order driving will be illustrated by taking the corresponding GOA circuits on odd-row (negative) gate lines Gate1 as an example.

Firstly, TFT4 receives the driving voltage of the previous gate line, and pre-charges the holding capacitor Cb so as to turn on the TFT1.

TFT1 outputs a gate line high potential Vgh. TFT2 and TFT3 receive the driving voltage of the next gate line, pulls down the gate line potential, and at the same time releases the charges of the holding capacitor Cb, so as to enable TFT1 in a closed state.

Due to odd-row output, TFT2 resets i.e., pulls down, the gate line input to the Vss1 potential. Finally, TFT5 is driven by the (N+3)th gate line, so as to reset the gate line output to the Vss2 potential, thus completing the driving of Gate1 shown in FIG. 4.

In order to better understand the present disclosure, a time sequence waveform is specifically illustrated below. FIG. 5 is a waveform diagram of a four-order driving gate driving voltage. It can be seen from the waveform diagram of the four-order driving that, there are four positive and negative voltages in total in the four-order driving gate driving voltage waveform, i.e., a turn-on voltage Vgh, a turn-off voltage Vss2 with a voltage difference of Vg, a voltage Vss3 higher than the turn-off voltage Vss2 (with a voltage difference of $V_{e(+)}$), and a voltage Vss1 lower than the turn-off voltage Vss2 (with a voltage difference of $V_{e(-)}$).

Figure 6:
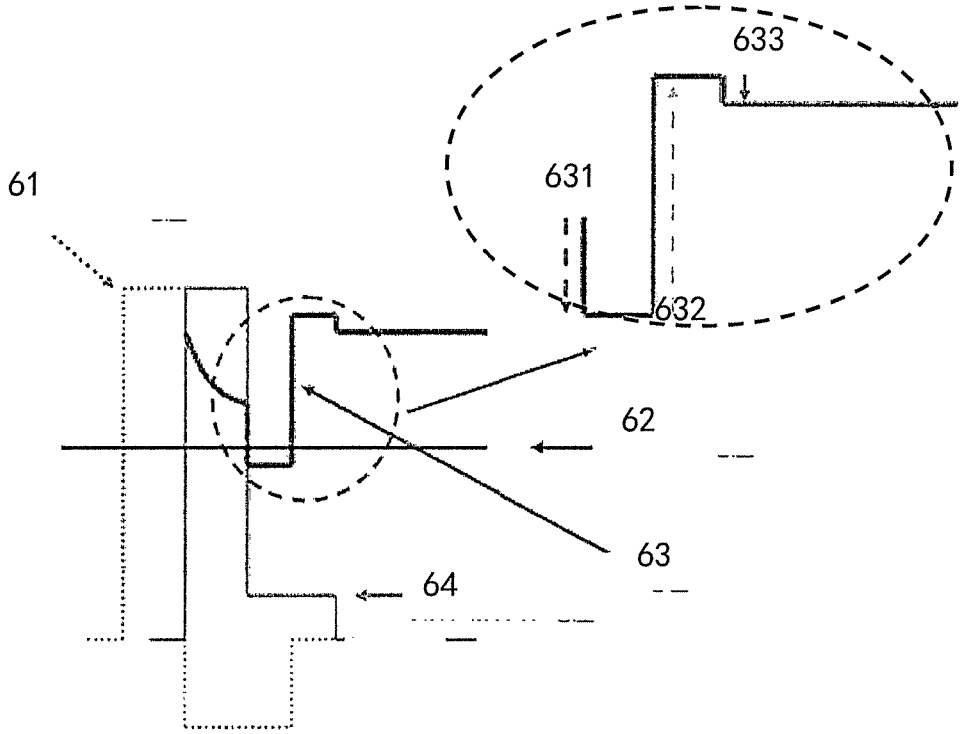
FIG. 6 is a voltage waveform schematic diagram of a four-order driving positive display electrode.

The positive gate driving wire voltage is different from the negative gate driving wire voltage. FIG. 6 shows the voltage waveform diagram of a positive display electrode, wherein reference number 61 represents an (N−1)th gate driving voltage, reference number 62 represents a common voltage, and reference number 64 represents an Nth gate driving voltage.

It can be seen from the drawing that a display electrode voltage 63 will be subjected to three times of voltage changes (as shown by a broken circle in the view) after being charged by source driving. The first one is a feed through voltage 631 generated by the parasitic capacitor Cgd when the current Nth gate driving wire is closed. The second one is a feed through voltage 632 generated by the storage capacitor Cs when the voltage of the previous (the (N−1)th) gate driving wire is pulled back, and this voltage is the most important voltage for pulling up the display electrode voltage 63 to a positive voltage range. The third one is a feed through voltage 633 generated by the parasitic capacitor Cgd when the voltage of the current Nth gate driving wire is pulled down. As this voltage is generated by the parasitic capacitor Cgd and has low amplitude in change, the influence thereof is low.

Figure 7:
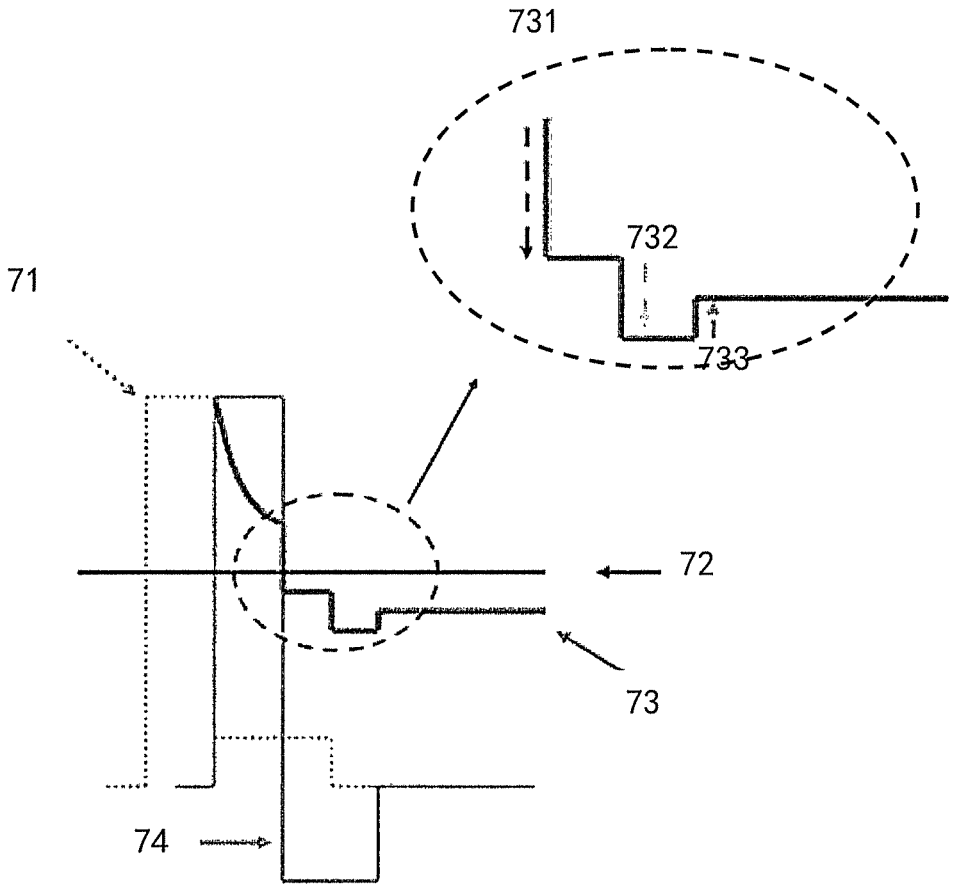
FIG. 7 is a voltage waveform schematic diagram of a four-order driving negative display electrode.

FIG. 7 shows a voltage waveform diagram of a negative display electrode, wherein reference number 71 represents an (N−1)th gate driving voltage, reference number 72 represents a common voltage, and reference number 74 represents an Nth gate driving voltage.

It can be seen from FIG. 7 that a display electrode voltage 73 will be subjected to three times of voltage changes after being charged by source driving. The first one is a feed through voltage 731 generated by the parasitic capacitor Cgd when the voltage of the current Nth gate driving wire is turned off. And as the voltage is turned off, the display electrode voltage 73 will be pulled down. The second one is a feed through voltage 732 generated by the storage capacitor Cs when the previous (the (N−1)th) gate driving wire is pulled down. And this voltage has a very important influence because of being a main component for adjusting the voltage to a negative voltage, and the overall voltage should be adjusted to a necessary level. The third one is a feed through voltage 733 generated by the parasitic capacitor Cgd when the voltage of the current Nth gate driving wire is pulled back. And as the pulled-back voltage has low amplitude, the overall influence thereof is low.

Due to the influence of the feed through voltage generated by the parasitic capacitor Cgd, if the positive voltage range and the negative voltage range need to be separated from each other, with regard to the positive voltage range, the voltage to be pulled up is high, and the voltage to be pulled up is formed by the feed through voltage generated by the storage capacitor Cs during pulling up the voltage of the previous gate driving wire. As the necessary voltage is high, the voltage when the previous gate driving wire is pulled back is high. For the formation of the negative display voltage range, it is also achieved by virtue of the voltage changes of the previous gate driving wire. Different from the positive display electrode voltage, the negative display voltage range is formed through a pull-down feed through voltage. The necessary pull-down voltage is lower than the positive pull-up voltage. By virtue of the above-mentioned four-order driving for the gate driving wire voltage, the influence of the feed through voltage on the pixel electrode can be reduced.

In conclusion, the present disclosure proposes a 5T1C four-order driver GOA circuit. In this circuit, two reset signals are used to pull down a gate output signal to a reset signal Vss1 and a reset signal Vss2 respectively with regard to odd rows, and to pull down the gate output signal to a reset signal Vss3 and the reset signal Vss2 respectively with regard to even rows, thus realizing the four-order driving for pixel units. Moreover, the driving circuit may effectively solve the problem of the influence of the feed-through voltage on the pixel electrodes, which cannot be solved by a two-order driving circuit, thus further improving the image quality effect.

The foregoing descriptions are merely preferred specific embodiments of the present disclosure, but the protection scope of the present disclosure is not limited thereto. Readily conceivable variations or substitutions, to any skilled one who is familiar with this art, within the disclosed technical scope of the present disclosure shall be incorporated in the protection scope of the present disclosure. Accordingly, the protection scope of the claims should be subjected to the protection scope of the present disclosure.

The invention claimed is:

1. A gate driver circuit, comprising multi-stage gate driver on array (GOA) circuits, an Nth stage GOA circuit of which comprises: an energy storage unit;

a charge unit, electrically connected between an (N−1)th gate line and the energy storage unit, and used for pre-charging the energy storage unit according to the signal of the (N−1)th gate line to obtain a voltage;

a driver unit, electrically connected to a dock output line and an Nth gate line, and used for pulling up the signal of the Nth gate line to a pull-up voltage according to the voltage and a dock pulse signal;

a first reset unit, electrically connected between the energy storage unit and a first reset voltage or a third reset voltage, and used for resetting the signal of the Nth gate line to the first reset voltage or the third reset voltage according to the signal of an (N+1) gate line and the first reset voltage or the third reset voltage; and a second reset unit, electrically connected between an Nth gate line and a second reset voltage, and used for resetting the signal of the Nth gate line to the second reset voltage according to the signal of an (N+3) gate line and the second reset voltage; wherein when the gate line connected with the Nth stage of GOA circuit is negative, the first reset unit resets the signal of the Nth gate line to the first reset voltage according to the signal of the (N+1) gate line and the first reset voltage, a negative voltage difference existing between the first reset voltage and the second reset voltage;

when the gate line connected with the Nth stage of GOA circuit is positive, the first reset unit resets the signal of the Nth gate line to the third reset voltage according to the signal of the (N+1) gate line and the third reset voltage, a positive voltage difference existing between the third reset voltage and the second reset voltage.

2. The gate driver circuit according to claim 1, wherein the second reset unit is a transistor provided with a gate, a first source/drain and a second source/drain, the gate being electrically connected with the (N+3) gate line, and the first source/drain and the second source/drain being electrically connected with the N gate line and the second reset voltage respectively.

3. The gate driver circuit according to claim 1, wherein the second reset unit is a transistor provided with a gate, a first source/drain and a second source/drain, the gate being electrically connected with the (N+3) gate line, and the first source/drain and the second source/drain being electrically connected with the N gate line and the second reset voltage respectively.

4. The gate driver circuit according to claim 1, wherein the second reset unit is a transistor provided with a gate, a first source/drain and a second source/drain, the gate being electrically connected with the (N+3) gate line, and the first source/drain and the second source/drain being electrically connected with the N gate line and the second reset voltage respectively.

5. The gate driver circuit according to claim 2, wherein the first reset unit comprises a first transistor and a second transistor, each being provided with a gate, a first source/drain and a second source/drain, the gates of the first transistor and the second transistor are electrically connected to each other and connected with the (N+1)th gate line, the first source/drain of the first transistor is electrically connected with the first end of the energy storage unit, and the first source/drain of the second transistor is electrically connected with the second end of the energy storage unit, and the second sources/drains of the first transistor and the second transistor are electrically connected to each other and electrically connected with the first reset voltage or the third reset voltage.

6. The gate driver circuit according to claim 5, wherein the charge unit is a transistor provided with a gate, a first source/drain and a second source/drain, the gate and the first source/drain of the charge unit are electrically connected with the (N−1)th gate line, and the second source/drain thereof is electrically connected with the first end of the energy storage unit.

7. The gate driver circuit according to claim 6, wherein the driver unit is a transistor provided with a gate, a first source/drain and a second source/drain, the first source/drain of the driver unit is electrically connected with the clock output line, the gate thereof is electrically connected with the first end of the energy storage unit, and the second source/drain thereof is electrically connected with the Nth gate line and the second end of the energy storage unit.

8. A gate driver circuit, comprising multi-stage gate driver on array (GOA) circuits, an Nth stage GOA circuit of which comprises: an energy storage unit;

a charge unit, electrically connected between an (N−1)th gate line and the energy storage unit, and used for pre-charging the energy storage unit according to the signal of the (N−1)th gate line to obtain a voltage;

a driver unit, electrically connected to a clock output line and an Nth gate line, and used for pulling up the signal of the Nth gate line to a pull-up voltage according to the voltage and a clock pulse signal;

a first reset unit, electrically connected between the energy storage unit and a first reset voltage or a third reset voltage, and used for resetting the signal of the Nth gate line to the first reset voltage or the third reset voltage according to the signal of an (N+1) gate line and the first reset voltage or the third reset voltage; and a second reset unit, electrically connected between an Nth gate line and a second reset voltage, and used for resetting the signal of the Nth gate line to the second reset voltage according to the signal of an (N+3) gate line and the second reset voltage; wherein when the gate line connected with the Nth stage of GOA circuit is negative, the first reset unit resets the signal of the Nth gate line to the first reset voltage according to the signal of the (N+1) gate line and the first reset voltage, a negative voltage difference existing between the first reset voltage and the second reset voltage;

when the gate line connected with the Nth stage of GOA circuit is positive, the first reset unit resets the signal of the Nth gate line to the third reset voltage according to the signal of the (N+1) gate line and the third reset voltage, a positive voltage difference existing between the third reset voltage and the second reset voltage.

* * * * *